US007258319B2

(12) United States Patent
Johanson et al.

(10) Patent No.: US 7,258,319 B2
(45) Date of Patent: Aug. 21, 2007

(54) SHIPPING BASE FOR APPLIANCES

(75) Inventors: James E. Johanson, Chatham, NY (US); Keith E. Antal, Sr., Valatie, NY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/990,013

(22) Filed: Nov. 21, 2001

(65) Prior Publication Data

US 2003/0057342 A1 Mar. 27, 2003

Related U.S. Application Data

(60) Provisional application No. 60/324,481, filed on Sep. 24, 2001.

(51) Int. Cl.
*A47B 91/00* (2006.01)
*B65D 19/00* (2006.01)

(52) U.S. Cl. ..... 248/346.02; 108/51.11; 108/53.3; 206/587; 248/678; 248/903

(58) Field of Classification Search ..... 248/346.01, 248/346.02, 346.04, 903, 678; 108/51.1, 108/53.3, 901; 156/292, 295; 206/386, 206/320, 492, 587
See application file for complete search history.

(56) References Cited

U.S. PATENT DOCUMENTS 3,902,692 A * 9/1975 Skinner ..... 108/56.1
4,428,306 A * 1/1984 Dresen et al. ..... 108/53.3
5,667,065 A * 9/1997 Fahrion ..... 108/53.1
5,758,855 A * 6/1998 Jordan et al. ..... 156/196
5,813,355 A * 9/1998 Brown et al. ..... 108/53.3
5,894,803 A * 4/1999 Kuga ..... 108/51.11
5,921,646 A * 7/1999 Hwang ..... 312/249.8
5,950,545 A * 9/1999 Shuert ..... 108/53.3
6,010,007 A * 1/2000 Moren et al. ..... 206/587
6,142,304 A * 11/2000 Moren et al. ..... 206/587
6,155,527 A 12/2000 Muyskens ..... 248/346.03
6,294,114 B1 * 9/2001 Muirhead ..... 156/292

FOREIGN PATENT DOCUMENTS

| | | |
|---|---|---|
| CH | 547206 | 3/1974 |
| DE | GM 7612361 | 10/1976 |
| DE | GM 7904758 | 6/1979 |
| JP | 2001-33068 A | 2/2001 |

OTHER PUBLICATIONS 3 sheets of drawings marked ES1295MI.EP1 Mar. 26, 1999 J.E.J.
3 sheets of drawings marked EP1289MI.EP4 May 20, 1999 J.E.J.
3 sheets of drawings marked ES1295MI.EP5 Jul. 1, 1999 J.E.J.

* cited by examiner

*Primary Examiner*—Amy J. Sterling
*Assistant Examiner*—Tan Le
(74) *Attorney, Agent, or Firm*—DLA Piper US LLP

(57) ABSTRACT

A shipping base for washers, dryers, and the like appliances. The base is in the form of a frame having top surfaces of outer parts thereof which are set relatively lower than the top surfaces of relative inner portions of the frame. Sockets are provided at the corners, to grip and receive the feet of the appliance. The sockets having radial ribs that deflect to grip the feet of the appliance.

13 Claims, 8 Drawing Sheets

SHIPPING BASE FOR APPLIANCES

CROSS-REFERENCE TO RELATED APPLICATION

This application claims the benefit of U.S. Provisional Application No. 60/324,481, filed Sep. 24, 2001.

FIELD OF THE INVENTION

The present invention relates to a shipping base for household appliances and the like.

BACKGROUND OF THE INVENTION

Household appliances, such as washing machines, dryers and the like, need to be delivered from the factory, to the store and to the customer in an undamaged condition. Such appliances are typically large, bulky and/or heavy. The exterior of such appliances commonly consists of a skin of metal panels that, for reasons of weight and economy, are not particularly robust. Also, such appliances often have exposed operable parts or connectors. The positioning of these elements and/or their proximity to the outer periphery of the appliance may place them at risk of damage during shipment and delivery. Delivery of a damaged or inoperable appliance can have a significant effect on customer satisfaction with a brand or a retailer. Even superficial damage to the exterior panels can easily render the appliance unacceptable to the customer and ultimately saleable only at an extremely reduced price. It is therefore desirable to provide for the support and protection of the appliance during shipping and delivery so as to avoid structural and cosmetic damage.

Appliances are sometimes shipped mounted on a base or pallet, which supports the bottom end and which is often slightly larger than the appliance itself. The base is designed to be handled mechanically, such as by a forklift, hand truck or the like. The base serves to protect the appliance by providing a relatively rigid and stable support or engagement surface. When being moved, the lifting mechanism will engage the base, typically without engaging the appliance itself.

One example of a prior shipping base, which was proposed for use with large appliances, is shown in FIGS. 10 and 11 of the drawings. The construction of this shipping base 10 has a relatively flat top 12, and has at each corner a circular socket 14 defining a well for placement of an adjustable leveling foot of the type typically provided at each corner of the appliance (not shown). Each socket 14 has four, essentially rigid, vertical ribs 16, which project radially inward into the well of the socket 14 and which are essentially rigid in use. The ribs are merely used to center the position of the appliance foot within the shipping base and do not assist in maintaining the base attached to the appliance. At the upper rim of the socket 14 are provided four rigid hooks 18 which are intended to retain the foot of the appliance within the well. The base embodiment shown in FIGS. 10 and 11 is made of plastic and formed by injection molding.

Other constructions of shipping bases are known. Such shipping bases are often made of wood and are mechanically attached to the bottom of the appliance by means of screws, bolts or the like. The fasteners for wooden frames are typically secured either to the internal framing of the appliance or to the lower edge of the outer skin panels.

SUMMARY OF THE INVENTION

In one aspect of the present invention, the base comprises a frame having multiple sides, each side adapted to extend adjacent one side of an appliance. The relatively outer peripheral edges of the sides of the base are preferably positioned below the skin panels of the appliance. At least one peripheral edge of the base is recessed relative to adjacent inner portions of the base. This recessing of the outer edge of the base creates a gap or space between the bottom edge of the appliance structure and/or its skin panels. During engagement of the base or during an impact on the base as a result of shipment or being dropped, the gap permits the outer portions of the base to deform or deflect upwards in response to load without readily engaging and/or damaging the adjacent portions of the appliance or its skin panels.

In another aspect of the invention, the base has one or more sockets or wells that form receptacles for the feet of an appliance. The sockets are preferably circular and provide an opening for receipt and engagement of the foot to be received. The socket is provided with a plurality of ribs, preferably extending vertically along at least a portion of the height of the socket. The ribs project inwardly from the sidewall of the well formed by the socket. The relatively lower ends of the ribs are preferably separated from the bottom surface of the socket. The separation can be formed either vertically from the plane of the bottom surface or by providing an opening in the bottom surface that surrounds each rib. The ribs are formed and configured so as to extend inwardly of the outer periphery of the foot of the appliance and to deflect when the foot is inserted into the socket. The ribs are preferably flexible so that they are adapted to deform adjacent the position of the engagement with the foot of the appliance when received in the receptacle. The ribs grip the foot of the appliance in the socket to maintain the appliance and the base together and to align the appliance on the base, such as during construction of the appliance. The top edges of the ribs are preferably beveled to facilitate insertion of the foot into the socket.

The basic aspects of the present invention may be combined in a number of forms. The preferred aspects of the various constructions may be used in conjunction with one another or used alone. The various features provide certain advantages over the prior art. These advantages will be described herein and will be understood by those skilled in the art upon reviewing the description and drawings.

BRIEF DESCRIPTION OF THE DRAWINGS

For the purpose of illustrating the invention, there are shown in the drawings forms of the invention which are presently preferred; it being understood, however, that this invention is not limited to the precise arrangements and instrumentalities shown. In the drawings.

DETAILED DESCRIPTION OF THE DRAWINGS

Figure 1:
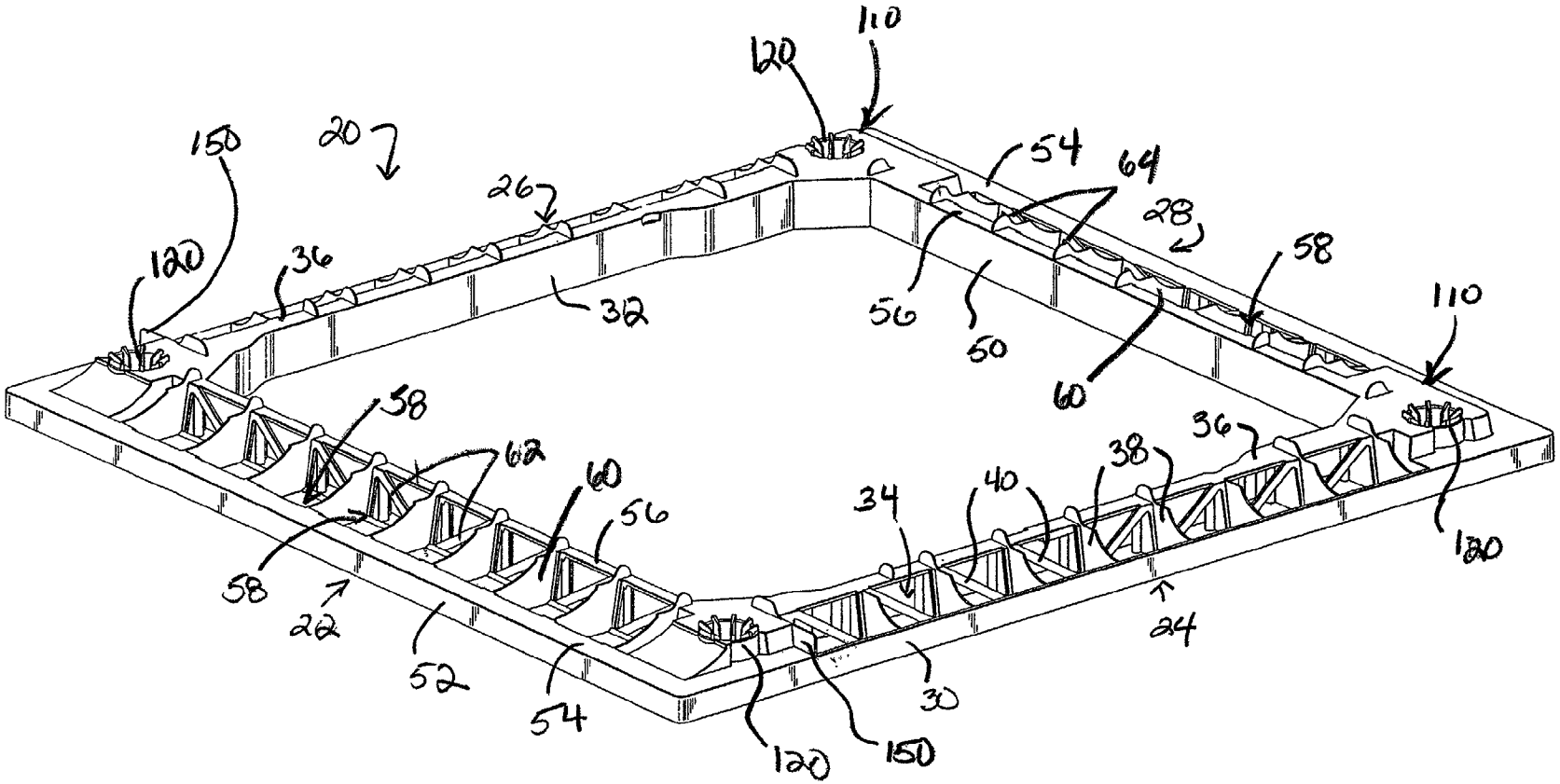
FIG. 1 is an isometric view of one embodiment of shipping base according to the invention.

Referring to FIGS. 1 to 9 of the accompanying drawings, where like numerals identify like elements, there is shown one form of a shipping base according to the present invention, which is identified generally by reference numeral 20. The shipping base 20 is preferably injection molded from a plastic material, such as polypropylene. The specific polymer, filler or reinforcement material can be varied to meet the specific requirements of the application.

Throughout this specification, terms such as "top", "bottom," and "vertical" are used in the interest of clarity with reference to an orientation of the base in a typical use with an appliance positioned there-above. It is not required that the base be provided below the appliance or that the base be maintained exactly in this orientation. Variation of the structures may be defined whereby portions of base are oriented vertically or at some angle with respect to horizontal. Also, when separated from the appliance, the base may be stored and transported in any convenient orientation.

The shipping base 20 as illustrated is in the general form of a rectangular frame, with a front 22, two sides 24, 26 and a rear or back 28. As will be explained below, the front 22 and back 28 of this preferred structure are intended to be, respectively, associated with the front and back panels (or the like) of a rectangular appliance or similar structure. The front of an appliance is the face that is positioned towards the user in normal use, and thus most likely to be visible. For example, the back of a washing machine, dryer or similar appliance is usually positioned against a wall, and its appearance is typically not as important to the marketability of the product. Thus, the back of the appliance may not be covered by panels or at the very least may not be covered by a panel having a specific cosmetic appearance. It should be understood, however, that the form of the shipping base may vary from rectangular depending on, among other factors, the shape or footprint of the appliance to which the base is to be attached.

Figure 5:
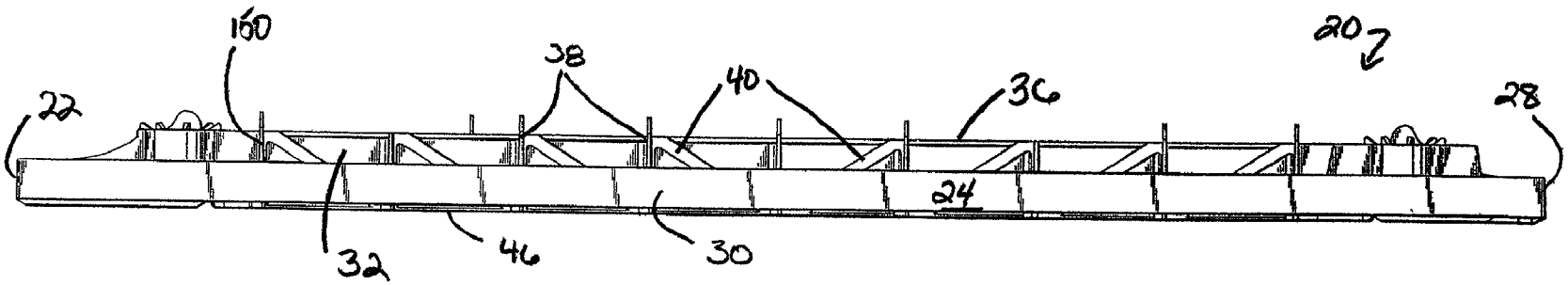
FIG. 5 is a left side elevation of the shipping base as shown in FIG. 1.
Figure 6:
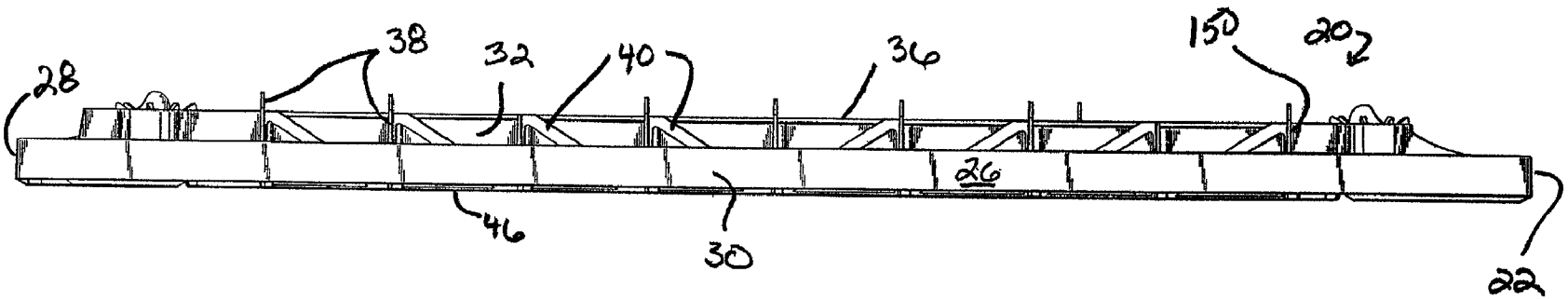
FIG. 6 is a right side elevation of the shipping base as shown in FIG. 1.

The sides 24, 26 of the shipping base 20 each comprise a continuous outside web 30, a continuous inside web 32, and a relatively open middle portion 34. The middle portion 34 as illustrated consists largely of a series of vertically positioned bars 38 extending between the outside web 30 and the top surface web 36, which is joined substantially perpendicular to the inside web 32. Diagonal braces 40 extend between adjacent vertical bars 38 and define the inside edge of the middle portion 34. Each brace 40 extends from the bottom of one bar 38 to the top of an adjacent bar 38, and as best seen in FIGS. 5 and 6 are angled upwardly away from the midpoint of the sides 24, 26.

Figure 2A:
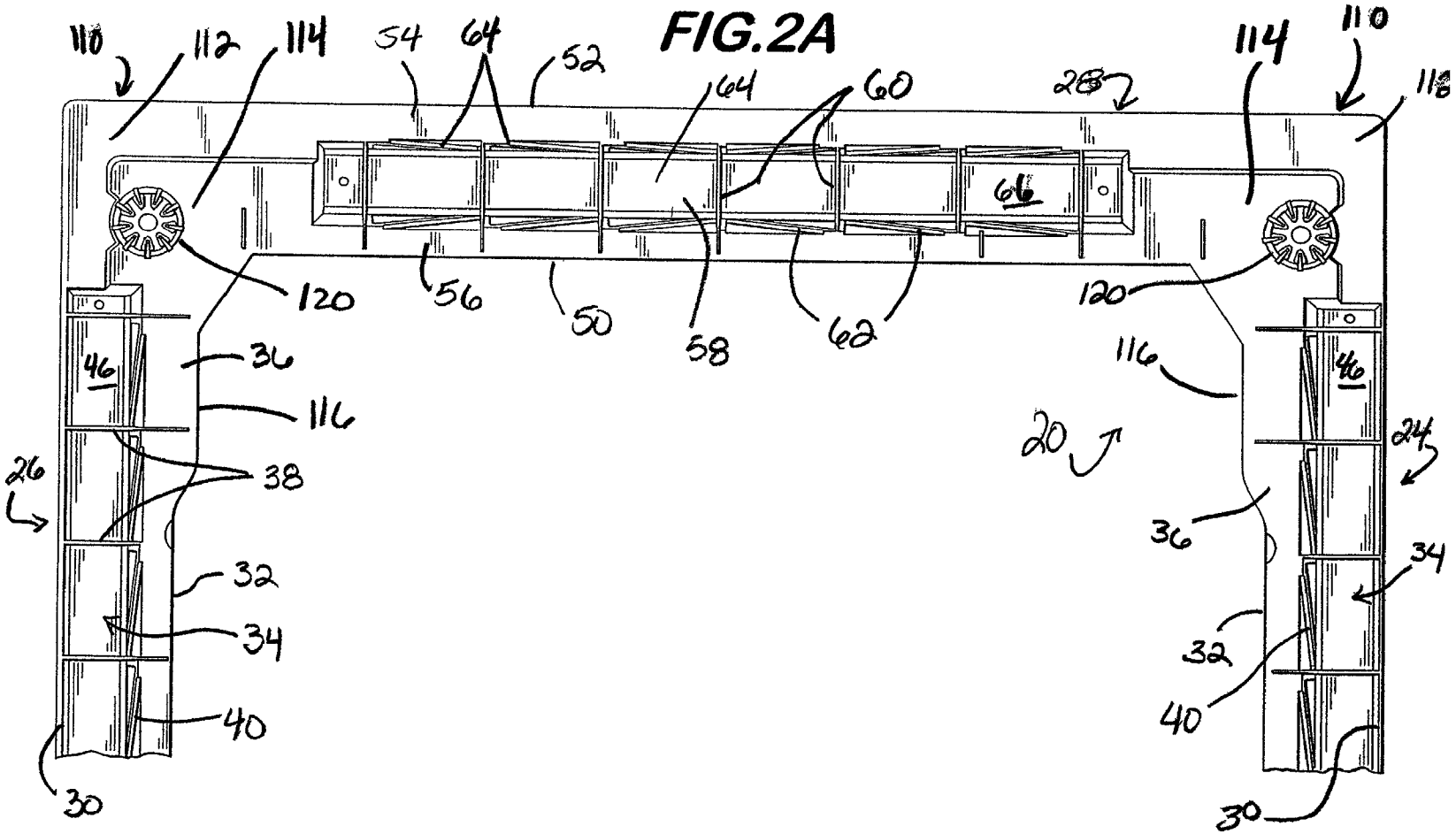
FIGS. 2A and 2B together are a top plan view of the shipping base of FIG. 1.
Figure 2B:
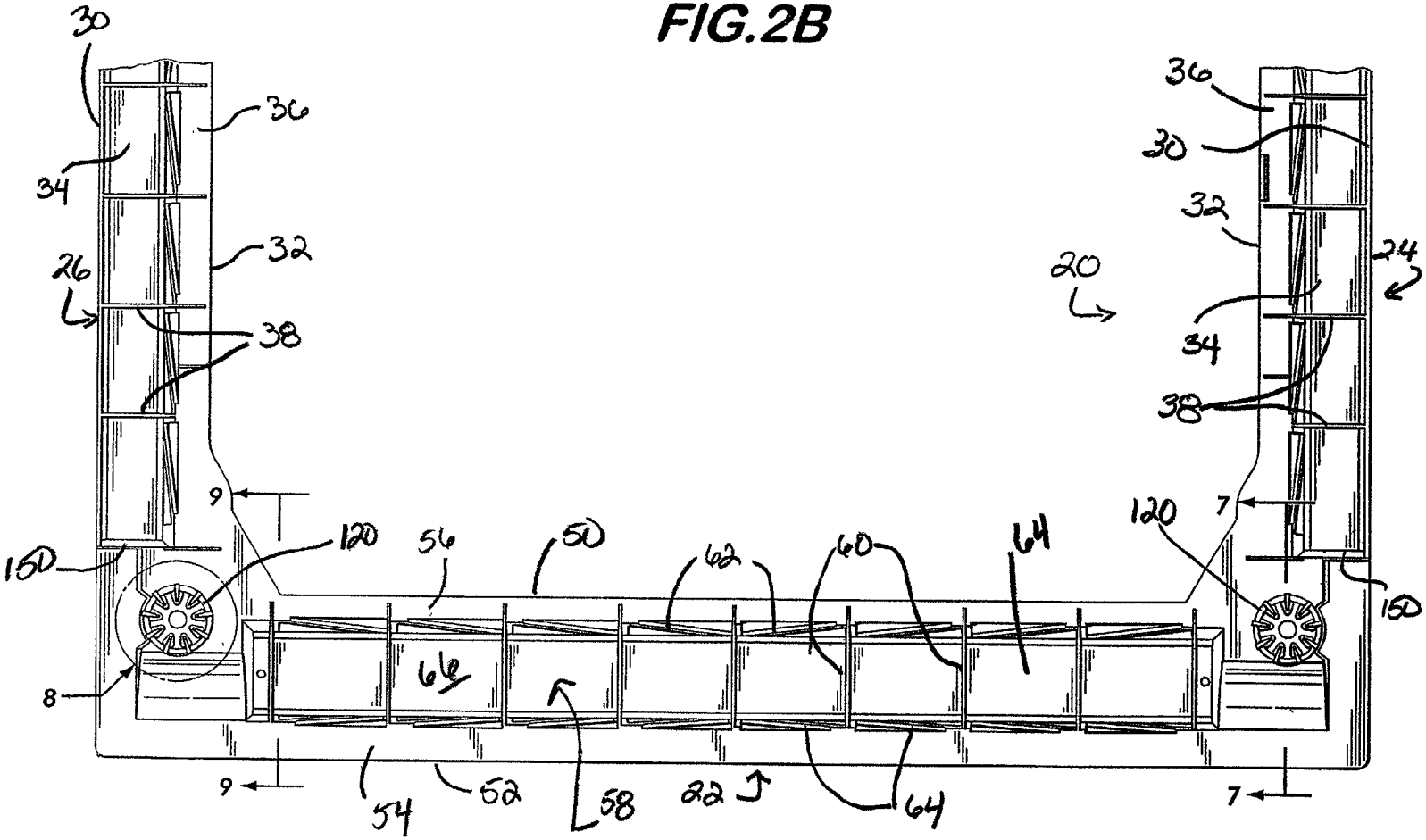
Figure 3:
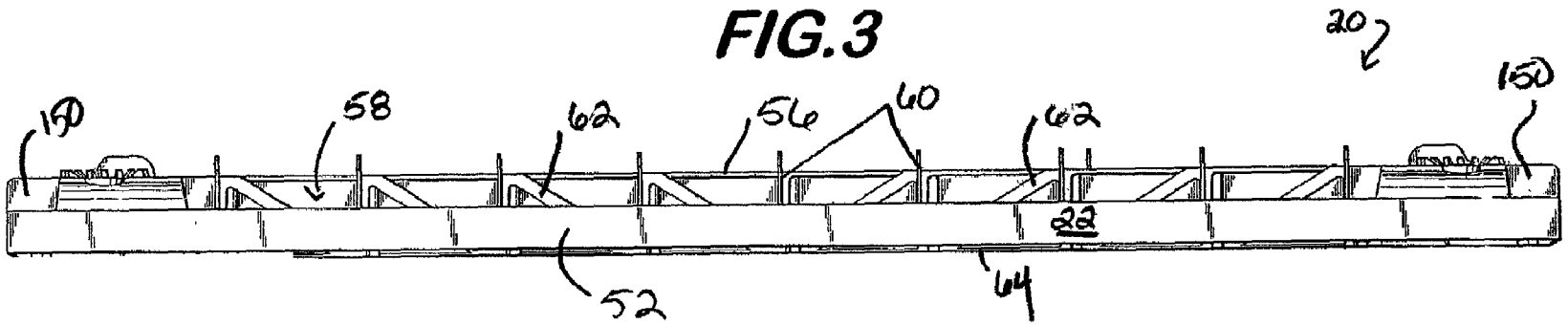
FIG. 3 is a front elevation of the shipping base of FIG. 1.
Figure 4:
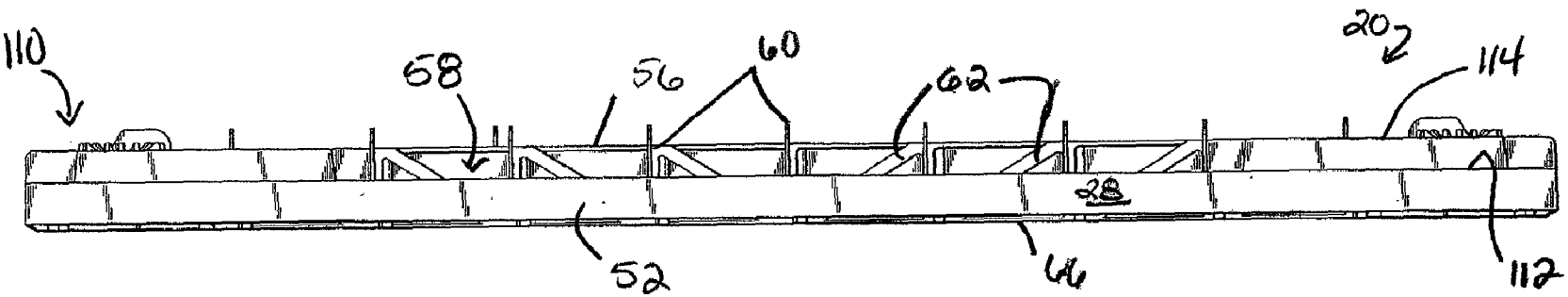
FIG. 4 is a rear elevation of the shipping base of FIG. 1.

As can be seen by reference to FIGS. 2A and 2B, a bottom land 46 extends between outside web 30 and the inner edge of the middle portion 34 as defined generally by the braces 40. Vertical bars 38 may extend past the inner edge of the middle portion 34, past the diagonal braces 40 and through to the inside web 32. This extension may be in the plane of the bars 38 or offset therefrom. Other webs and braces may also be provided as desired.

The front 22 and back 28 of the base 20 are of generally similar construction to the sides 24, 26. As illustrated, the front 22 and back 28 have an outer wall 52 and an outer top web 54, extending inwardly from the outer wall 52. In addition, inner top surface web 56, which is similar to web 36, extends outwardly from the inside wall 50. A middle portion 58 consists largely of vertical bars 60, similar in form to bars 38 on the sides, and a bottom land 66. Diagonal braces 62, constructed similarly to the braces 40, are also provided on the inner side of the middle portion 58. A series of diagonal braces 64 are also illustrated at the outer edge of the middle portion 58. These braces 62 and 64 help to stiffen the overall construction.

As may be seen from the side in FIGS. 3, 4, 5 and 6, the bottom lands 46, 66 define the lowest part of the shipping frame 20, and normally rest on a floor. The bottom edges of the inside and outside webs 30, 32, 50 and 52 are at the same relative level as one another, and are positioned only slightly above floor level. However, the plane of the top edges of these webs are substantially offset from one another, with the top edge of the outer side walls 26 being relatively lower (i.e., closer to the floor) than the inner top surface web 36 and with the outer webs 54 on the front and back of the base being relatively lower than the inner top surface web 56.

Figure 9:
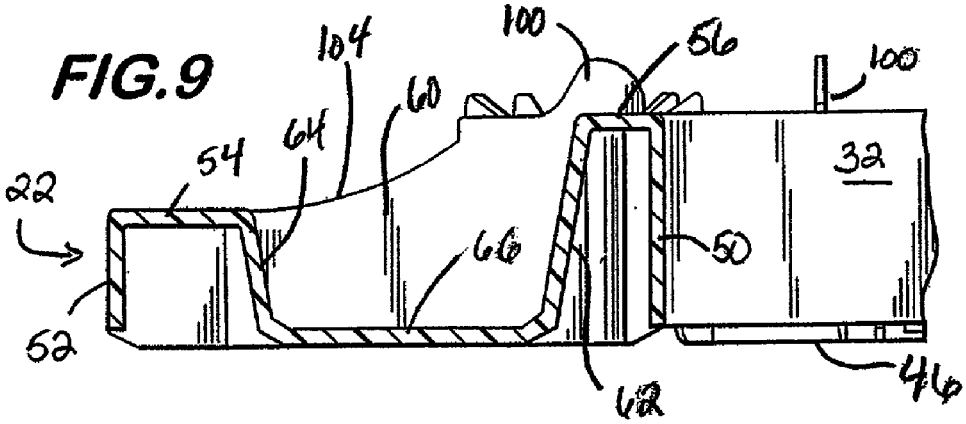
FIG. 9 is an enlarged fragmentary section as taken along the line 9-9 in FIG. 2B.

On each of the four sides 22, 24, 26, 28 there is provided a series of vertical ribs 100 that project from the top surface webs 36 and 56. The shape and position of these projecting ribs may vary depending on the form of the appliance. A number of the ribs 100 coincide in position with the vertical bars 38 and 60. As seen in FIG. 9, the vertical bars 60 on the front and back portions of the base 20 have a concave top edge 104, so that it merges smoothly into the outer land 54. A similar transition is provided on bars 38 on the side portions 24, 26 of the base 20, as the bars transition from the top surface 36 to the top edge of the outer wall 30. As illustrated particularly in FIG. 7, a transition surface 106 is provided at the corners on opposite ends of the front 22 of the base. Again, the shape of these particular transitions can be varied as desired, depending on the shape and form of the appliance to be attached to the base 20. In addition, projections 100 may be omitted. At the back corners of the base 20, which are indicated generally by the reference numeral 110, the inner top surface webs 36 and 56 meet at 114 and form a step down to the outer surface 112, which is in the same plane as the front top surface 54 and the top edge of the outer side walls 30. Again, the form of the step 114, 112 or the transition surface 106 may vary as desired.

As best seen in FIGS. 2A and 2B, the inside walls 32 of the sides 24, 26 bulge inwards at 116 so that the sides 24, 26, and in particular their inner top surfaces 36, 56, are wider near the corners.

Figure 7:
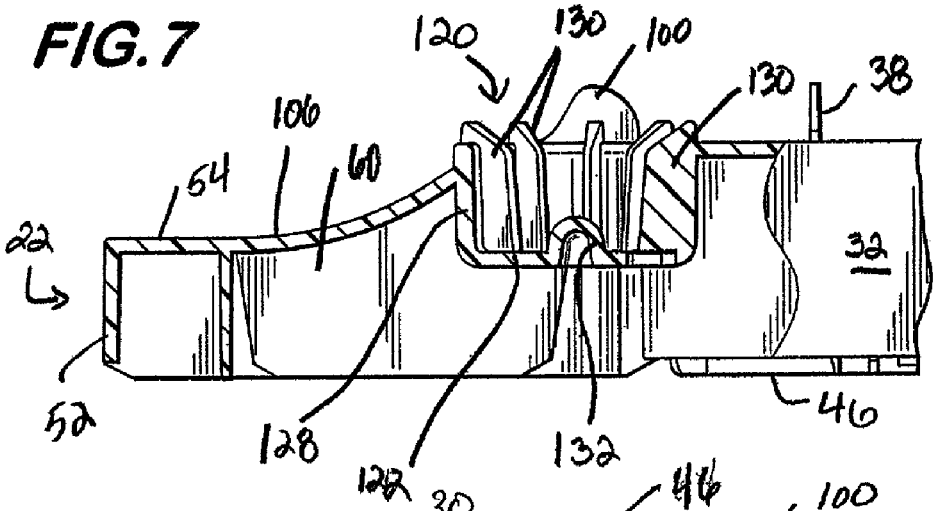
FIG. 7 is an enlarged fragmentary section as taken along the line 7-7 in FIG. 2B.
Figure 8:
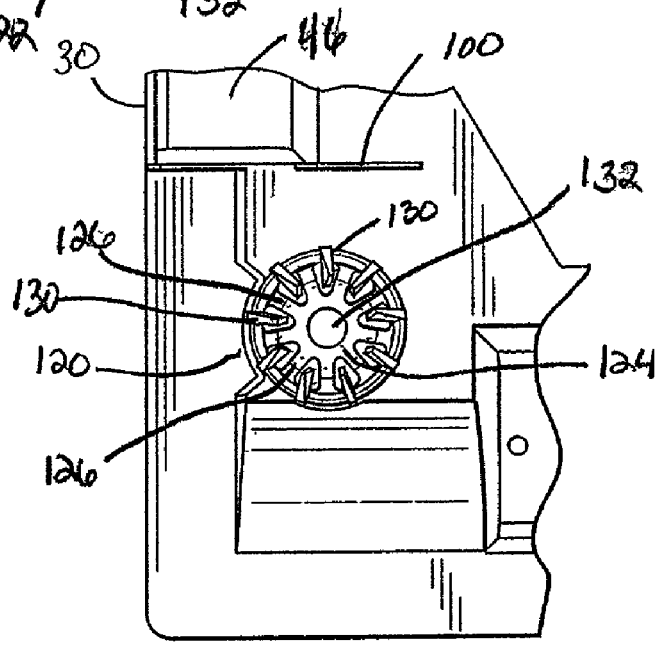
FIG. 8 is an enlarged fragmentary plan view of the portions of the shipping base as designated in FIG. 2B.

At each corner of the base 20 is provided a foot-well in the form of a socket 120. As illustrated in FIGS. 7 and 8, each socket 120 comprises a generally cylindrical well extending downwards from the upper surface of the base. The bottom 122 of the socket is positioned above the level of the lands 46 and 64. The bottom 122 of the well is in the form of a spider, having a central surface 124 and a series of projecting arms 126 radiating outwardly, which join with the sidewall 128 of the socket. A series of vertical fins 130 project radially inward from the wall 128 of the socket. The number of fins corresponds to the spaces defined by the radiating arms 126. In the embodiment shown, the fins are evenly spaced and are not attached to the arms of the spider. The bottom edges of the fins are preferably positioned flush with the top surface of the spider arms. The fins are formed and positioned so as to be capable of deflecting sideways away from their radial position. The top edges of the fins are beveled and slope downwards towards the center of the well to assist in directing the feet of the appliance into the wells.

The fins may take any form as desired and are not required to extend radially inward or to stand vertically upright. One possible alternative structure would comprise fins formed on an angle that, at least in part, spiral down the sidewall of the socket. Also, the fins may vary in size depending on the depth of the well. Other variations are also contemplated and will be understood by those in the art upon review of the present text and drawings. The intent of the fins is to engage the foot that is inserted in the socket, to affect the overall position the appliance on the base and to resiliently secure the base to the appliance.

A bulge 132 projects upwards from the center of the bottom wall 122 of the well of each socket. The bulge 132 limits the depth that the corresponding appliance foot can be inserted into the well. This limitation ensures that the foot will be engaged by the fins and will not be pushed under the bottom edges of the fins. If this were to occur, removal of the foot from the well would become difficult, and depending on the flexibility of the fins almost impossible to remove the foot without the necessity of damaging the base (which may in-turn cause damage to the appliance).

In use, a dryer, washing machine or other appliance is positioned on the base 20, optionally with the frame of the appliance resting on the projections 100, ribs 38, 60 and/or top surfaces 36, 56. The adjustable feet of the appliance project into the sockets 120. A completed appliance may be placed onto the base 20 after final assembly. However, it is preferred to position the frame and feet of the appliance on the base 20 at an early stage in the assembly process for the appliance, and to use the base to support and handle the appliance as assembly continues.

Figure 10:
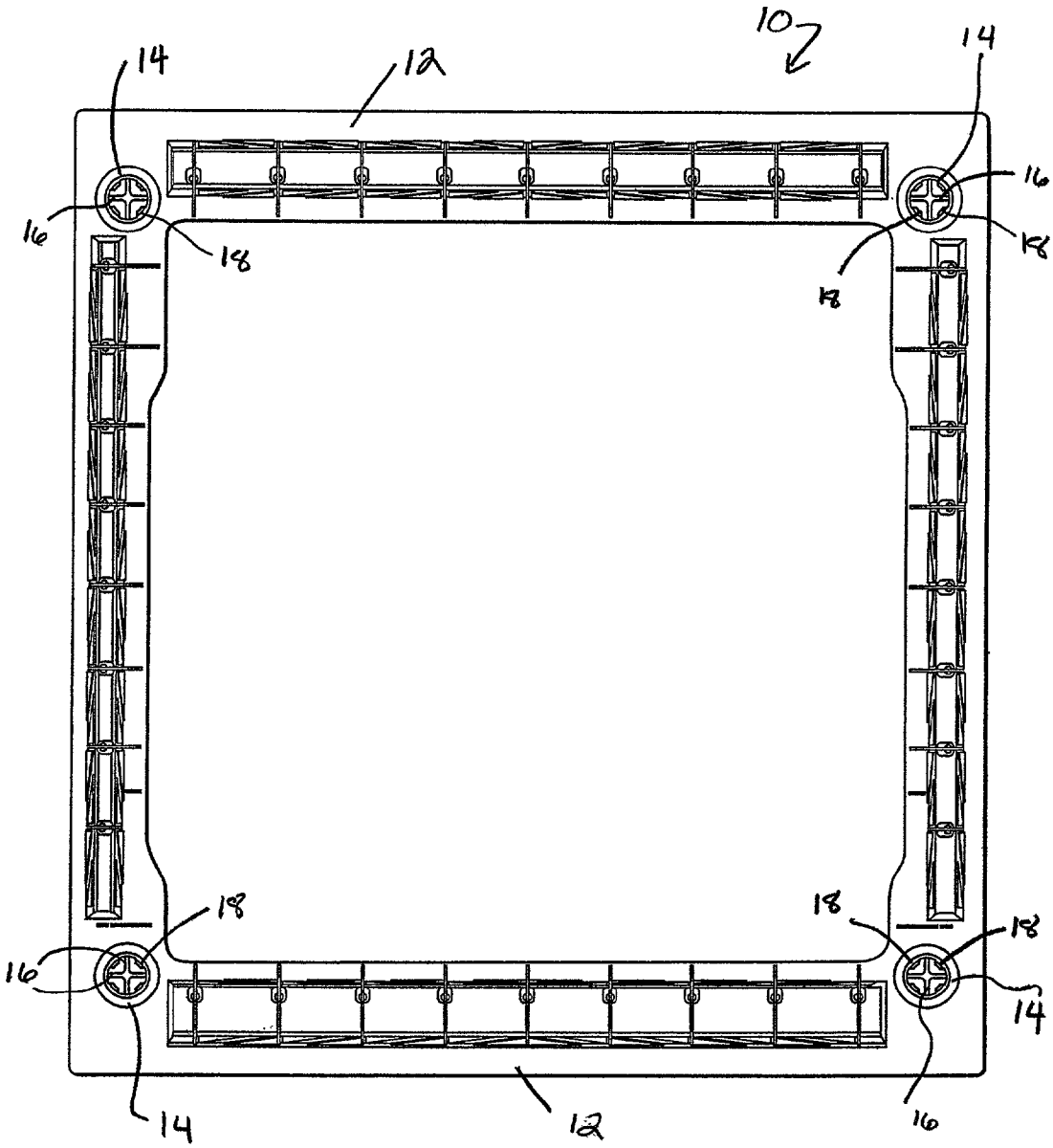
FIG.10 PRIOR ART
FIG. 10 is a top plan view of a shipping base construction as previously proposed.
Figure 11:
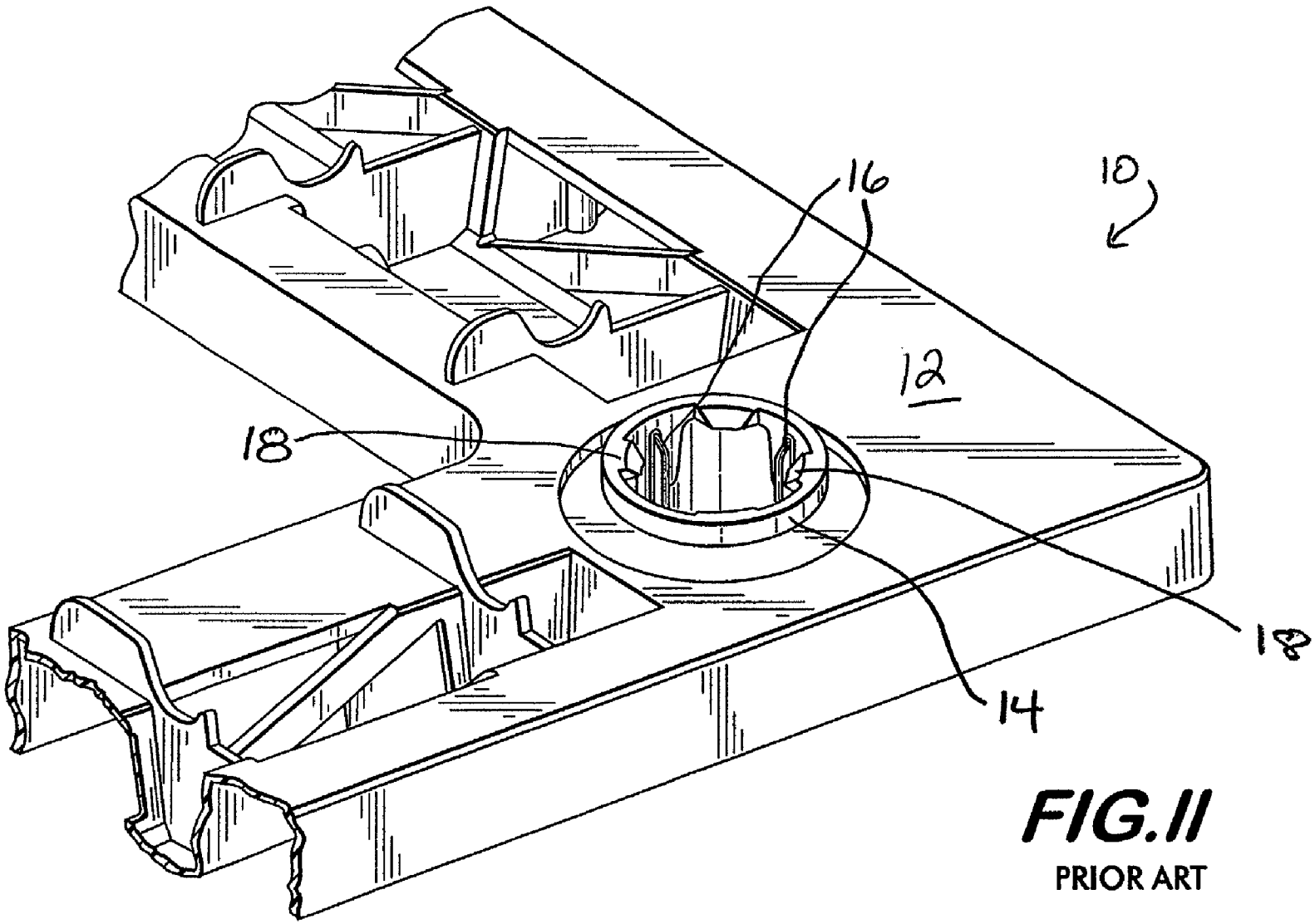
FIG. 11 PRIOR ART
FIG. 11 is an enlarged fragmentary isometric view of a portion of the shipping base of FIG. 10.

The feet of the appliance may be circular, hexagonal or otherwise shaped and are typically screw-adjustable in the amount of their extension from the frame of the appliance. During attachment of the base to the appliance, the feet are positioned to extend part of the depth of the sockets. The feet may rest on the bulges 132. The width of each foot is smaller than diameter of the sockets, and larger in diameter than the space between the innermost edges of the fins. The feet are accommodated in the sockets by displacing the fins from their radial positions. The fins deflect or deform so as to engage the feet. The engagement of the feet in this manner fixes the position of the appliance on the base and resiliently secures the base to the underside of the appliance. Thus, there is no relative horizontal or vertical movement between the base and the appliance. (In the prior shipping base shown in FIGS. 10 and 11, the fins 16 center the feet in the well but do not engage the edges of the feet. Thus, at least some movement between the feet and the base, both horizontal and vertical, is possible. The rigid hooks 18 provided a limit to the relative vertical movement between the two.)

The structures of the base are contemplated to be varied to accommodate the intricacies of the appliance base and assembly. In addition, assembly of the appliance is often performed while a portion of the structure is attached to the base. Thus, the form of the diagonal braces 64 and the position and form of the vertical bars 38 and 60 may be varied to accommodate the underside structures and frame of the appliance. Tabs 150, as shown in FIGS. 1, 2B, 3, 5 and 6, may be used to position the front panel of the appliance prior to it being secured to the remainder of the construction by screws. Other structures on the base may also be included to accommodate specific parts of the appliance. Gas line connections and relays are typical components that are vulnerable to shock. Protections and/or relief on the base structures adjacent the areas of the appliance where these parts are located may be provided. Thus, the recess created by the height differential of the upper surfaces of the base or a relief that is otherwise provided serves to protect and defend the appliance structures during handling and shipment.

The appliance may be lifted by holding the base on top of the paddles of a fork lift, the engagement surfaces of a hand truck or clamp truck, or the like (not shown). The engagement of these machines may press against the outer webs 30 of the sides 24, 26 of the base 20, and grip the base essentially frictionally. In performing this operation, the edges of the base may deform or bow. Because the top of the outer edges of the base are relatively lower than the inner parts, a gap is formed below the lower edge of the exterior of the appliance. Thus, the edges can bow upwards to an appreciable extent without the risk that they will contact or damage skin panels or other portions of the appliance. The base 20 may also be made wider than the footprint of the appliance, so that the sidewalls of the appliance are not brought into engagement with the lifting device. Further protection is provided when the appliance is lifted off of or replaced onto the floor. At these times, the appliance may be set on one edge and then rocked to a vertical position, placing additional force on the edge of the base that initially engages the floor. The gap created by the base also provides at least some protection in the event the appliance is dropped.

The shipping base may be attached to the appliance in any number of ways, over and above or as an alternative to the engagement by the fins within the sockets on the feet of the appliance. Often shipping bases are secured to the appliances by means of machine screws, staples or other attachment devices. Further, the outer wrapping for the appliance, such as corrugated cardboard, may be secured to the shipping base.

The present invention may be embodied in other specific forms without departing from the spirit or essential attributes thereof and, accordingly, reference should be made to the appended claims, rather than to the foregoing specification, as indicating the scope of the invention. For example, although the base has been shown with sockets at all four corners, some appliances have adjustable feet at only two corners. A base intended for use with such an appliance may be provided with only two sockets, and with other formations at the other two corners. Rectangular wells and sockets formed to provide for non-adjustable feet may be included.

Also, depending on the location of the feet of the particular appliance, some or all of the sockets may be positioned away from the corners of the base, or along the front, back or sides. In the embodiment shown, all four sides of the base are recessed downwards. In some cases, lowering of the outer edge may not be required, such as the rear of the appliance. Thus, any combination of raised and lowered surfaces may be provided on the edges. Other variations are contemplated and will be understood by those in the art.

What is claimed is:

1. A base for supporting an article during shipping, the article having a series of feet projecting from one side thereof, and the article having a series of peripheral side panels, the base comprising:

a frame having one or more side edges, each side edge adapted to extend along a side of an article, the base having one or more sockets having internal sidewalls defining wells in the frame that form receptacles for receipt and engagement of feet of the article, each socket having a bottom wall, the bottom wall of the sockets defined by a central portion and a plurality of arms projecting radially outwardly from the central portion to sidewall, each of the arms separated from one another by a hole; and a plurality of elongated flexible ribs extending vertically along the internal sidewall of the sockets from the upper portion of the sidewall to a position adjacent the bottom wall, and projecting inwardly into the well of the sockets, the ribs adapted to deflect and resiliently deform in response to the engagement with the feet of the article upon insertion into the sockets, to secure the base to the article and to align the side edges of the frame adjacent the peripheral side panels of the appliance;

the holes in the bottom wall being disposed below a corresponding rib within the socket, the holes being dimensioned and configured to provide separation between a bottom edge of each rib and the bottom wall of the socket.

2. A base as claimed in claim 1, for supporting a four-sided article, wherein the frame has four sides, each side adapted to extend along one of the four side panels of the article with relatively outer peripheral edge portions of the base positioned adjacent bottom surfaces of the article.

3. A base as claimed in claim 2, wherein an outer peripheral edge of each of the sides of the frame is recessed relative to an inner portion of the base along the corresponding side panel, creating a gap between the base and adjacent portions of the article along each side thereof.

4. A base as claimed in claim 1, wherein the ribs are beveled at their upper edges adjacent the open end of the wells.

5. A base as claimed in claim 1, wherein a relatively outer peripheral edge portion of at least one side of the frame is recessed relative to inner portions of the frame along the at least one side, the recess of the outer edge portion along the at least one side creating a gap between the base and adjacent portions of the article.

6. A base as claimed in claim 1, wherein the central portion of the bottom wall of each socket further comprises a bulge projecting upward from the bottom wall of the socket, the bulge being structured to resist movement of a foot of an appliance below the bottom edges of the ribs.

7. A base for supporting an article during shipping, the article having a series of feet projecting from one side thereof, and the article having a series of peripheral side panels, the base comprising:

a frame having one or more side edges, each side edge adapted to extend along a side of an article, the base having one or more sockets each having an internal sidewall and defining a well in the frame that forms a receptacle for receipt and engagement of the feet of the article, each socket having a bottom wall, the bottom wall of the socket defined by a central portion and a plurality of arms projecting radially outwardly from the central portion to the sidewall, each of the arms separated from one another by holes; and a plurality of flexible ribs extending axially alone the internal sidewall of the sockets and projecting inwardly into the well of the sockets, the ribs adapted to deflect and resiliently deform in response to the engagement with the feet of the article upon insertion into the sockets, to secure the base to the article and to align the side edges of the frame adjacent the peripheral side panels of the appliance, the holes in the bottom wall of the sockets being disposed below a corresponding rib within the socket, the holes being dimensioned and configured to provide separation between a bottom edge of the ribs and the bottom wall of the socket, wherein the bottom wall of the socket is disposed above a bottom of the base.

8. A base as claimed in claim 7, wherein the ribs are beveled adjacent the upper edge of the socket to facilitate insertion of the foot of the appliance into the socket.

9. A base as claimed in claim 7, wherein the side edges extend sufficiently outward from the inner portion of the frame so that side panels of an appliance disposed on the base will be disposed substantially over the side edges.

10. A base for shipping and supporting an appliance, the appliance having a series of feet projecting from the bottom surface thereof, and the appliance having a series of peripheral side panels, the base comprising:

a frame having one or more side edges and a central opening the side edges adapted to extend along a side panel of an appliance, the side edges having a top surface disposed below a top surface of an inner portion of the base, whereby the frame resists contact between a side edge and a peripheral side panel of an appliance disposed on the frame upon upward bending of a portion of the frame, the base having at least one socket that defines a well for receipt of a foot of the appliance;

a plurality elongated flexible ribs extending vertically along an internal sidewall of the socket and radially projecting inwardly into the well, the ribs adapted to deform in response to engagement with the foot of the appliance upon insertion into the socket to grip the foot of the appliance and to maintain the appliance and the base together, and a bottom wall within the socket, the bottom wall having a central portion and a plurality of projecting arms extending outwardly from the central portion to the sidewall of the socket, the projecting arms separated from one another by a hole defined in the bottom wall, the holes being disposed below each of the ribs within the socket, the holes providing separation between a bottom edge of each rib and the bottom wall of the socket.

11. A base as claimed in claim 10, wherein the bottom wall of the socket is disposed above a bottom of the base.

12. A base as claimed in claim 10, wherein the bottom wall of the socket is disposed above a bottom of the base; whereby additional cushioning is provided by the base for an appliance disposed on the base.

13. A base as claimed in claim 10, wherein the bottom wall of the socket further comprises a bulge projecting upward from the central portion, the bulge being structured to resist movement of a foot of an appliance below the bottom edges of the ribs.

* * * * *

UNITED STATES PATENT AND TRADEMARK OFFICE

CERTIFICATE OF CORRECTION

PATENT NO. : 7,258,319 B2
APPLICATION NO. : 09/990013
DATED : August 21, 2007
INVENTOR(S) : Johanson et al.

It is certified that error appears in the above-identified patent and that said Letters Patent is hereby corrected as shown below:

In Column 7
At line 59, change “alone” to --along--.

In Column 8
At line 24, change “opening the” to --opening, the--.

Signed and Sealed this

Fourth Day of March, 2008

JON W. DUDAS
*Director of the United States Patent and Trademark Office*